US012111120B2

(12) United States Patent
Joardar et al.

(10) Patent No.: US 12,111,120 B2
(45) Date of Patent: Oct. 8, 2024

(54) MICROCHANNEL HEAT EXCHANGER

(71) Applicant: Carrier Corporation, Palm Beach Gardens, FL (US)

(72) Inventors: Arindom Joardar, Jamesville, NY (US); Tobias H. Sienel, Baldwinsville, NY (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 17/674,193

(22) Filed: Feb. 17, 2022

(65) Prior Publication Data

US 2022/0299272 A1 Sep. 22, 2022

Related U.S. Application Data

(60) Provisional application No. 63/162,332, filed on Mar. 17, 2021.

(51) Int. Cl.
*F28F 1/02* (2006.01)

(52) U.S. Cl.
CPC ..... *F28F 1/022* (2013.01); *F28F 2260/02* (2013.01)

(58) Field of Classification Search
CPC .... F28F 1/022; F28F 2260/02; F28D 1/05383
USPC ..... 165/167, 177
See application file for complete search history.

(56) References Cited

U.S. PATENT DOCUMENTS 4,497,363 A 2/1985 Heronemus
4,570,700 A * 2/1986 Ohara ..... F28F 1/02 165/170
5,476,141 A 12/1995 Tanaka
5,941,303 A * 8/1999 Gowan ..... F28F 9/0207 165/174
6,546,998 B2 * 4/2003 Oh ..... F28D 1/0535 165/172
8,776,874 B2 * 7/2014 Hu ..... F28F 19/00 165/146
2002/0066554 A1 * 6/2002 Oh ..... F28D 1/0535 165/172
2005/0051317 A1 * 3/2005 Chin ..... F28D 1/05391 165/177
2009/0166016 A1 * 7/2009 Hu ..... F28D 1/0443 165/151
2010/0050685 A1 * 3/2010 Yanik ..... F28F 1/022 62/515
2012/0227945 A1 * 9/2012 Taras ..... F28F 17/005 165/172

(Continued)

FOREIGN PATENT DOCUMENTS

JP H06185885 A 7/1994
JP 2014001868 A 1/2014

OTHER PUBLICATIONS

European Search Report for Application No. 22162563.5; Issued Aug. 5, 2022; 7 Pages.

*Primary Examiner* — Raheena R Malik
(74) *Attorney, Agent, or Firm* — CANTOR COLBURN LLP

(57) ABSTRACT

A heat exchange tube for use in a heat exchanger including a first nose and a second nose aligned on an axis along a width of the heat exchange tube; an end port immediately adjacent to the first nose; wherein the end port has a non-circular, polygonal shape.

17 Claims, 10 Drawing Sheets

A: Tube Width, B1,2: Wall Thickness, C: Port Width, D1,2: Port Height, E: Tube Height, F: Nose Thickness, G: Web Thickness, H: End-Port Width, R1-R4: Corner Radii

(56) References Cited

U.S. PATENT DOCUMENTS

| | | | | |
|---|---|---|---|---|
| 2013/0153174 | A1* | 6/2013 | Taras | F28F 3/027 165/104.19 |
| 2014/0224462 | A1* | 8/2014 | Kamada | F28F 1/128 165/181 |
| 2018/0313610 | A1* | 11/2018 | Fukada | F28F 1/02 |
| 2020/0355439 | A1 | 11/2020 | Mercer et al. | |
| 2021/0033350 | A1* | 2/2021 | Jiang | F28D 1/05383 |
| 2021/0156622 | A1* | 5/2021 | Jiang | F28F 1/022 |
| 2021/0262744 | A1* | 8/2021 | Leffler | F25B 39/00 |

* cited by examiner

A: Tube Width, B: Wall Thickness, C: Interior-Port Width, D: Interior-Port Height,
E: Tube Height, F: Nose Thickness, G: Web Thickness, H: End-Port Width,
J: End-Port Height, R1-R3: Corner Radii

A: Tube Width, B1,2: Wall Thickness, C: Port Width, D1,2: Port Height, E: Tube Height, F: Nose Thickness, G: Web Thickness, H: End-Port Width, R1-R4: Corner Radii

A: Tube Width, B1,2: Wall Thickness, C: Port Width, D1,2: Port Height, E: Tube Height, F: Nose Thickness, G: Web Thickness, H: End-Port Width, R1-R4: Corner Radii

A: Tube Width, B: Wall Thickness, C: Interior-Port Width, D1: Interior-Port Height (max), D2: Interior-Port Height (min), E: Tube Height, F: Nose Thickness, G: Web Thickness, H: End-Port Width, J: End-Port Height, K: Throat position, R1-R4: Corner Radii

A: Tube Width, B: Wall Thickness, C: Interior-Port Width, D: Interior-Port Height,
E: Tube Height, F: Nose Thickness, G: Web Thickness, H: End-Port Width,
J: End-Port Height, R1-R3: Corner Radii

MICROCHANNEL HEAT EXCHANGER

CROSS-REFERENCE TO RELATED APPLICATIONS

This application claims the benefit of U.S. Provisional Application No. 63/162,332, filed Mar. 17, 2021, both of which are incorporated by reference in their entirety herein.

BACKGROUND

The present disclosure relates to the field of heat exchangers. More particularly, the present disclosure relates to microchannel heat exchangers.

Microchannel heat exchangers have emerged in the market as an effective heat transfer apparatus for HVAC applications. The weight of the heat exchange tubes in a microchannel heat exchanger has a large influence on the overall cost. Reducing the amount of material used in the heat exchange tubes, however, can have a negative effect on the burst pressure of the heat exchanger.

BRIEF DESCRIPTION

According to an embodiment, a heat exchange tube for use in a heat exchanger includes a first nose and a second nose aligned on an axis along a width of the heat exchange tube; an end port immediately adjacent to the first nose; wherein the end port has a non-circular, polygonal shape.

In addition to one or more of the features described herein, or as an alternative, further embodiments may include wherein the end port is rectangular.

In addition to one or more of the features described herein, or as an alternative, further embodiments may include wherein an interior side of the end port immediately adjacent to the first nose has a curvature of zero.

In addition to one or more of the features described herein, or as an alternative, further embodiments may include wherein the end port has an aspect ratio of width to height ranging from 0.1 to 10.

According to another embodiment, a heat exchange tube for use in a heat exchanger includes a first nose and a second nose aligned on a Y axis along a width of the heat exchange tube; an end port immediately adjacent to the first nose; a first interior port positioned between the first nose and the second nose; a second interior port positioned between the first nose and the second nose; the first interior port having a wall having a first thickness, B2, along a Z axis perpendicular to the Y axis; the second interior port having a wall having a second thickness, B1, along the Z axis; wherein the first thickness is greater than the second thickness.

In addition to one or more of the features described herein, or as an alternative, further embodiments may include wherein the first interior port is immediately adjacent to the end port.

In addition to one or more of the features described herein, or as an alternative, further embodiments may include a further first interior port, the further first interior port having a wall having the first thickness, B2, along the Z axis.

In addition to one or more of the features described herein, or as an alternative, further embodiments may include wherein the first interior port and the further first interior port are positioned on opposite sides of the second interior port along the Y axis.

In addition to one or more of the features described herein, or as an alternative, further embodiments may include a further second interior port, the further second interior port having a wall having the second thickness, B1, along the Z axis.

In addition to one or more of the features described herein, or as an alternative, further embodiments may include wherein the first interior port, the second interior port, the further second interior port and the further first interior port are arranged in sequence along the Y axis.

In addition to one or more of the features described herein, or as an alternative, further embodiments may include wherein a ratio of B2/B1 ranges from 1.01 to E/(2B1), where E is a height of the heat exchange tube along the Z axis.

In addition to one or more of the features described herein, or as an alternative, further embodiments may include wherein a ratio of B2/B1 ranges from 1.1 to 1.5.

According to another embodiment, a heat exchange tube for use in a heat exchanger includes a first nose and a second nose aligned on a Y axis along a width of the heat exchange tube; a port positioned between the first nose and the second nose; the port having an interior port height along a Z axis perpendicular to the Y axis; wherein the interior port height varies along the Y axis to define a throat in the port.

In addition to one or more of the features described herein, or as an alternative, further embodiments may include wherein the interior port height increases and decreases along the Y axis.

In addition to one or more of the features described herein, or as an alternative, further embodiments may include wherein an interior surface of the port is V-shaped.

In addition to one or more of the features described herein, or as an alternative, further embodiments may include wherein an interior surface of the port is curved.

In addition to one or more of the features described herein, or as an alternative, further embodiments may include wherein the interior port height has a minimum at a center of the port as measured along the Y axis.

In addition to one or more of the features described herein, or as an alternative, further embodiments may include wherein the interior port height has a minimum offset from a center of the port as measured along the Y axis.

In addition to one or more of the features described herein, or as an alternative, further embodiments may include wherein the port has a width, C, measured along the Y axis and the interior port height has a minimum at a distance K from a from a side wall of the port, where K ranges from 0.1×C to 0.9×C.

In addition to one or more of the features described herein, or as an alternative, further embodiments may include wherein K ranges from 0.4×C to 0.6×C.

In addition to one or more of the features described herein, or as an alternative, further embodiments may include wherein interior port height has a maximum of D1 and a minimum of D2, wherein D2 ranges from 0.1×D1 to 0.98×D1.

In addition to one or more of the features described herein, or as an alternative, further embodiments may include wherein D2 ranges from 0.65×D1 to 0.85×D1.

Technical effects of embodiments of the present disclosure include a heat exchanger including heat exchange tubes using reduced material and satisfying burst strength requirements.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
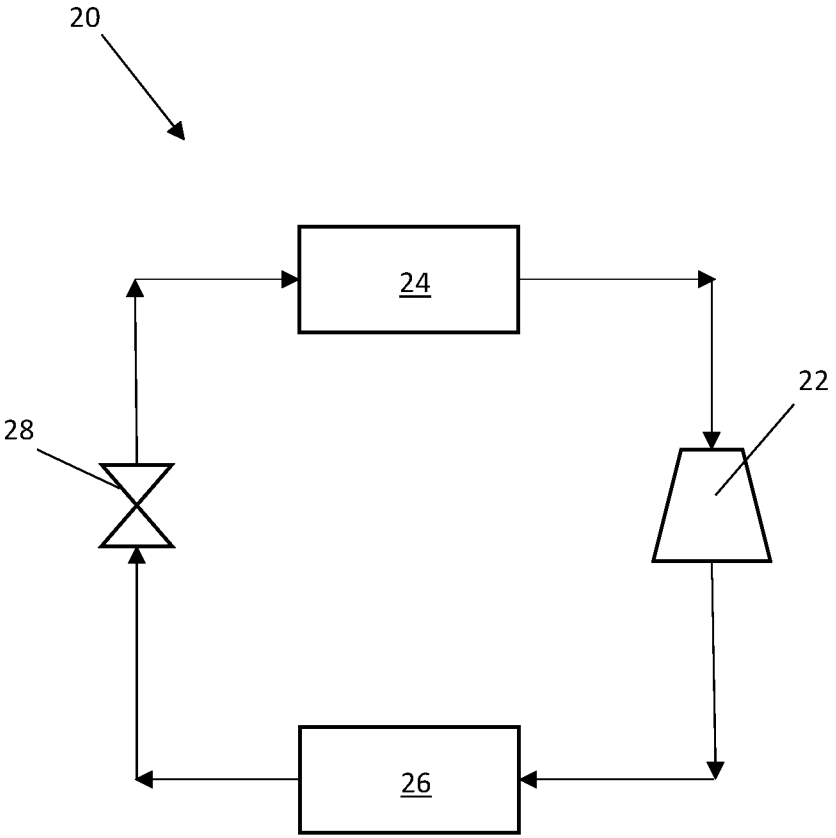
FIG. 1 depicts a vapor compression cycle.

Referring now to FIG. 1, a vapor compression refrigeration cycle 20 of a heating, ventilation, air conditioning, and refrigeration (HVAC&R) system is schematically illustrated. Exemplary HVAC&R systems include, but are not limited to, residential, split, packaged, chiller, rooftop, supermarket, and transport HVAC&R systems, for example. A refrigerant is configured to circulate through the vapor compression cycle 20 such that the refrigerant absorbs heat when evaporated at a low temperature and pressure and releases heat when condensed at a higher temperature and pressure.

Within this vapor compression refrigeration cycle 20, the refrigerant flows in a clockwise direction as indicated by the arrows. The compressor 22 receives refrigerant vapor from the heat exchanger 24 (e.g., a heat absorption heat exchanger or evaporator) and compresses the refrigerant to a higher temperature and pressure, with the relatively hot vapor then passing to heat exchanger 26 (e.g., a heat rejection heat exchanger or gas cooler/condenser) where the refrigerant is cooled by a heat exchange relationship with a cooling medium (not shown) such as air. The refrigerant then passes from the heat exchanger 26 to an expansion device 28, wherein the refrigerant experiences a pressure drop and phase change prior to passage to the heat exchanger 24. The refrigerant then passes to the heat exchanger 24 where the refrigerant increases enthalpy through heat exchange relationship with a heating medium (not shown) such as air. The refrigerant then returns to the compressor 22 where the cycle is repeated.

Figure 2:
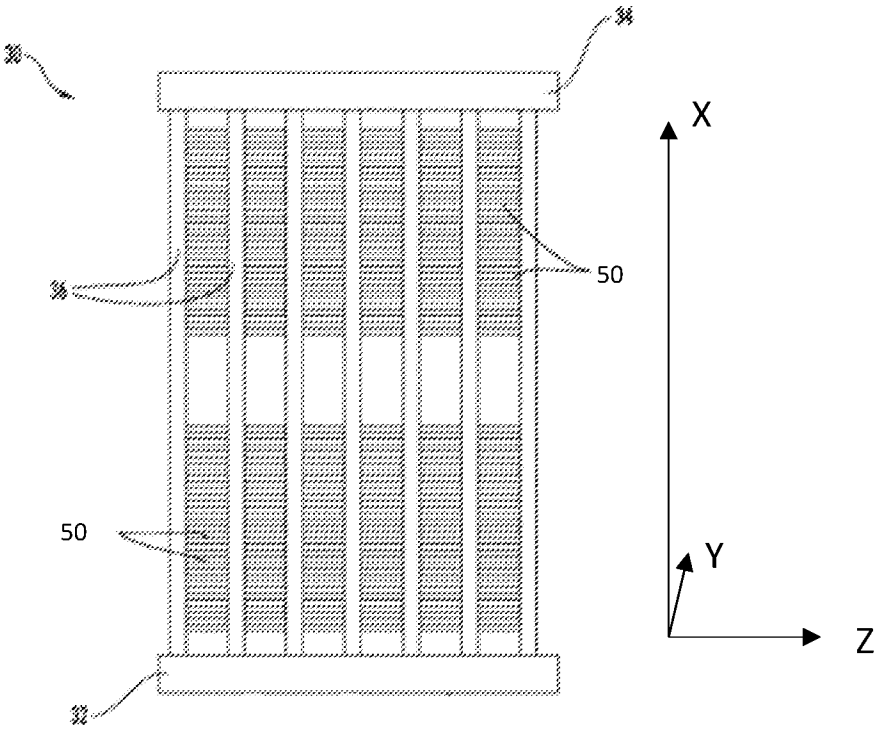
FIG. 2 depicts a heat exchanger in an example embodiment.

Referring now to FIG. 2, an example heat exchanger 30 is shown. Heat exchanger 30 may serve as heat exchanger 24 and/or heat exchanger 26 of FIG. 1. The heat exchanger 30 includes at least a first manifold or header 32, a second manifold or header 34 spaced apart from the first manifold 32, and a plurality of heat exchange tubes 36 extending in a spaced, parallel relationship between and connecting the first manifold 32 and the second manifold 34. In the illustrated, non-limiting embodiments, the first header 32 and the second header 34 are oriented generally along a first direction and the heat exchange tubes 36 extend generally along a second direction between the two headers 32, 34. The heat exchange tubes 36 extend between the first and second manifolds 32, 34, having a length along a first, longitudinal axis, X. A width of the heat exchange tubes 36 is measured along a second, lateral axis, Y. A height of the heat exchange tube tubes 36 is measured along a third axis, Z. Axes X, Y and Z are perpendicular to each other.

Figure 3:
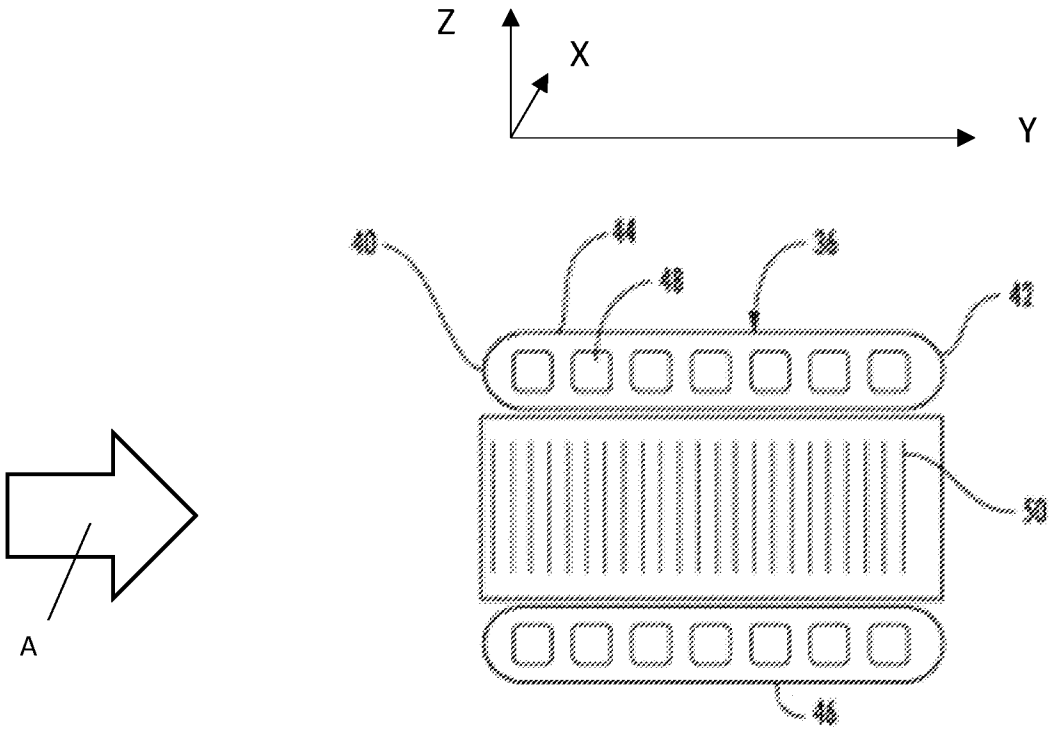
FIG. 3 is a cross-sectional view of heat exchange tubes and a fin in an example embodiment.

Referring now to FIG. 3, a cross-sectional view of an embodiment of heat exchange tubes 36 is illustrated. The heat exchange tubes 36 include a flattened, microchannel heat exchange tube having a first nose 40, a second nose 42, a first outer surface 44 and a second outer surface 46. The first nose 40 and the second nose 42 are aligned on the Y axis. In the example of FIG. 3, the first nose 40 of the heat exchange tube 36 is upstream of its respective second nose 42 with respect to airflow, A, passing through the heat exchanger 30 and flowing across the heat exchange tubes 36. An interior of the heat exchange tube 36 includes a plurality of discrete ports 48 that extend over a length of the heat exchange tube 36 from an inlet end to an outlet end and establish fluid communication between the first and second manifolds 32, 34. The heat exchange tube 36 including discrete ports 48 may be formed using known techniques and materials, including but not limited to, extruding or folding.

A plurality of fins 50 are located between the heat exchange tubes 36 and form a metallurgical bond with tube 40 surface. In some embodiments, the fins 50 are formed from a continuous strip of fin material folded in a ribbon-like serpentine fashion thereby providing a plurality of closely spaced fins 50 that extend generally orthogonally to the heat exchange tubes 36. Thermal energy exchange between one or more fluids within the heat exchange tubes 36 and an air flow, A, occurs through the outside of outer surfaces 44, 46 of the heat exchange tubes 36 collectively forming a primary heat exchange surface, and also through thermal energy exchange with the fins 50, which defines a secondary heat exchange surface.

Figure 4:
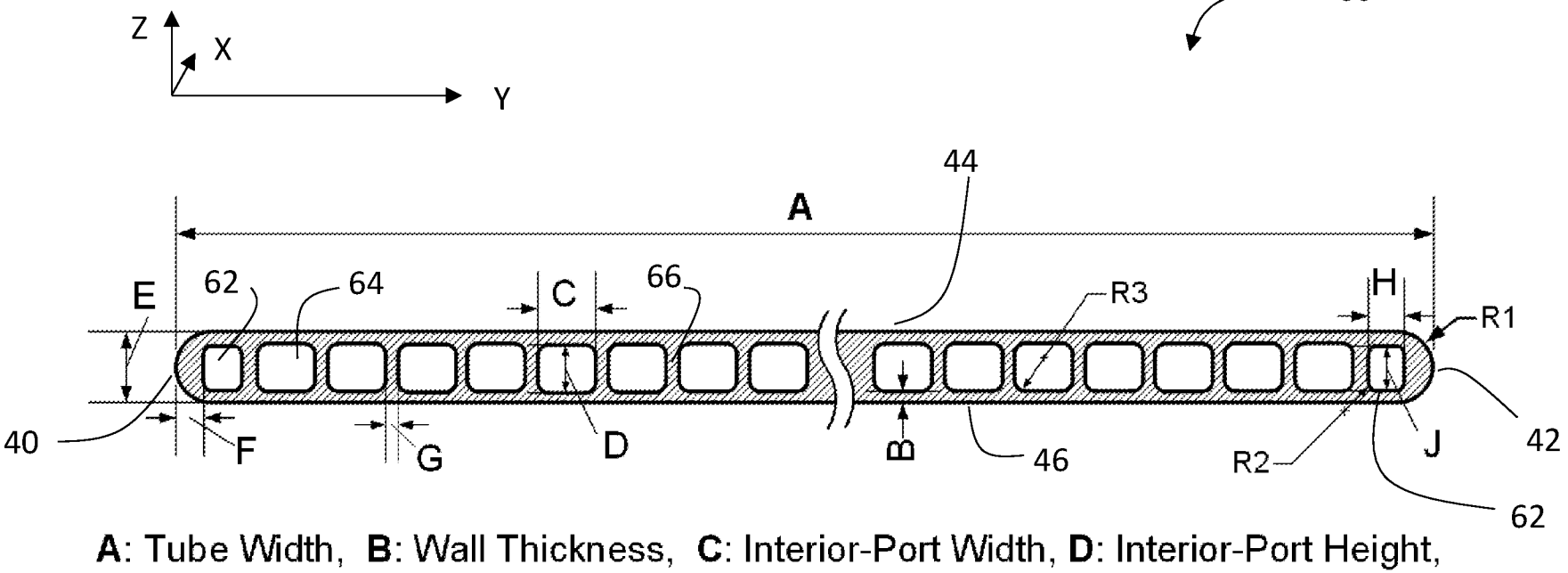
FIG. 4 is a cross-sectional view of a heat exchange tube in an example embodiment.

FIG. 4 is a cross-sectional view of a heat exchange tube 60 in an example embodiment. The cross-sectional view of FIG. 4 depicts the heat exchange tube 60 in the Y-Z plane. The heat exchange tube 60 includes the first nose 40, the second nose 42, the first outer surface 44 and the second outer surface 46, as shown in FIG. 3. The ports internal to the heat exchange tube 60 include end ports 62 that are immediately adjacent to the first nose 40 and the second nose 42, respectively. Ports located between the end ports 62 are referenced as interior ports 64. The interior ports 64 are separated along the Y axis by webs 66. FIG. 4 identifies various dimensional references used herein.

The first nose 40 and/or the second nose 42 may be any shape, such as semicircular or flat. The nose thickness, F, of one or both of the first nose 40 and the second nose 42 may be lower, higher or equal to web thickness, G, of webs 66. One or both of the end ports 62 have a generally non-circular, polygonal shape (e.g., rectangular, square). An interior wall of the end port 62 immediately adjacent to the adjacent nose 40/42 has a curvature of zero. The non-circular shape of one or both of the end ports 62 helps reduce peak stresses on the heat exchange tube 60 when subjected to an internal pressure during operation.

In an example embodiment, one or both of the end ports 62 comprises a four-sided polygon with or without rounded corners. Each side of the end port 62 is a straight line with zero curvature. A radius, R2, at one or more interior corners of the end port 62 may be less than 20% of the port minor dimension (e.g., the end port width along the Y axis shown in FIG. 4).

All the ports, both end ports 62 and interior ports 64, have an aspect ratio defined as width (along the Y axis) divided by height (along the Z axis). The aspect ratio of one or both of the end ports 62 may be smaller, equal or greater than an aspect ratio of one or more interior ports 64. In an example embodiment, the aspect ratio of the one or both of the end ports 62 ranges from 0.1 and 10.

Figure 5:
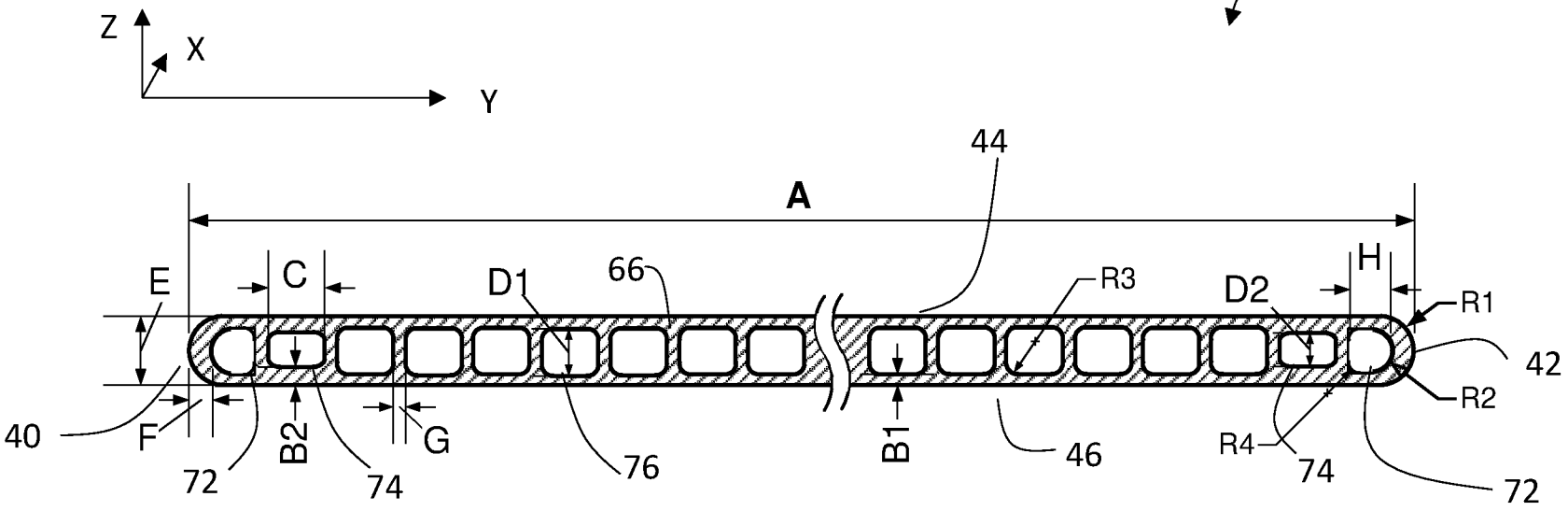
FIG. 5 is a cross-sectional view of a heat exchange tube in an example embodiment.

FIG. 5 is a cross-sectional view of a heat exchange tube 70 in an example embodiment. The cross-sectional view of FIG. 5 depicts the heat exchange tube 70 in the Y-Z plane. The heat exchange tube 70 includes the first nose 40, the second nose 42, the first outer surface 44 and the second outer surface 46. The ports internal to the heat exchange tube 70 include end ports 72 that are immediately adjacent to the first nose 40 and the second nose 42, respectively. Ports located between the end ports 72 include as first interior ports 74 and second interior ports 76. The end ports 72, first interior ports 74 and second interior ports 76 are separated along the Y axis by webs 66. The first interior ports 74 may be immediately adjacent to the end ports 72. FIG. 5 identifies various dimensional references used herein.

In heat exchange tube 70, one or both of the end ports 72 have a rounded interior wall facing the first nose 40 and the second nose 42, respectively. The first interior ports 74 have differing wall thickness (measured along the Z axis) than the second interior ports 76. As shown in FIG. 5, two first interior ports 74 have different wall thickness, B2, as compared to the end ports 72 and the second interior ports 76. In one embodiment, the wall thickness (B2) of the first interior ports 74 is greater than a wall thickness (B1) of the end ports 72 and the second interior ports 76. In FIG. 5, both the wall thicknesses (B2) from the inside surface of the first interior port 74 to the first outer surface 44 and the inside surface of first interior port 74 to the second outer surface 46 is greater than the wall thickness (B1) of the end ports 72 and the second interior ports 76. It is understood that only one of the wall thicknesses (B2) from the inside surface of the first interior port 74 to the first outer surface 44 and the inside surface of the first interior port 74 to the second outer surface 46 may be greater than the wall thickness (B1) of the end ports 72 and the second interior ports 76.

Referring to FIG. 5, D2=E−2*B2 and D1=E−2*B1, where D2 is a height of a first interior port 74 measured along the Z axis, D1 is a height of a second interior port 76 measured along the Z axis, E is a height of the heat exchange tube 70 along the Z axis, B2 is a wall thickness of the first interior port 74 and B1 is a wall thickness of the second interior port 76. In example embodiments, D2 is less than D1, which reduces the maximum principal stress on the heat exchange tube 70 when subjected to an internal working pressure.

A ratio of B2/B1 may range from 1.01 to an upper limit of E/(2B1). In one example embodiment, the ratio of B2/B1 ranges from 1.1 to 1.5.

An aspect ratio (AR) of the first interior ports 74 may be different than an aspect ratio of the second interior ports 76. In one embodiment, the aspect ratio of one or both of the first interior ports 74 is greater than the aspect ratio of the end ports 72 and the aspect ratio of the second interior ports 76. Also, the aspect ratio of one or both of the end ports 72 is less than that of the second interior ports 76. The aspect ratio of the first interior ports 74 is higher than that of the second interior ports 76. This may be summarized as $AR_{end\text{-}port\ 72}<AR_{int\text{-}port\ 76}<AR_{int\text{-}port\ 74}$.

Figure 6:
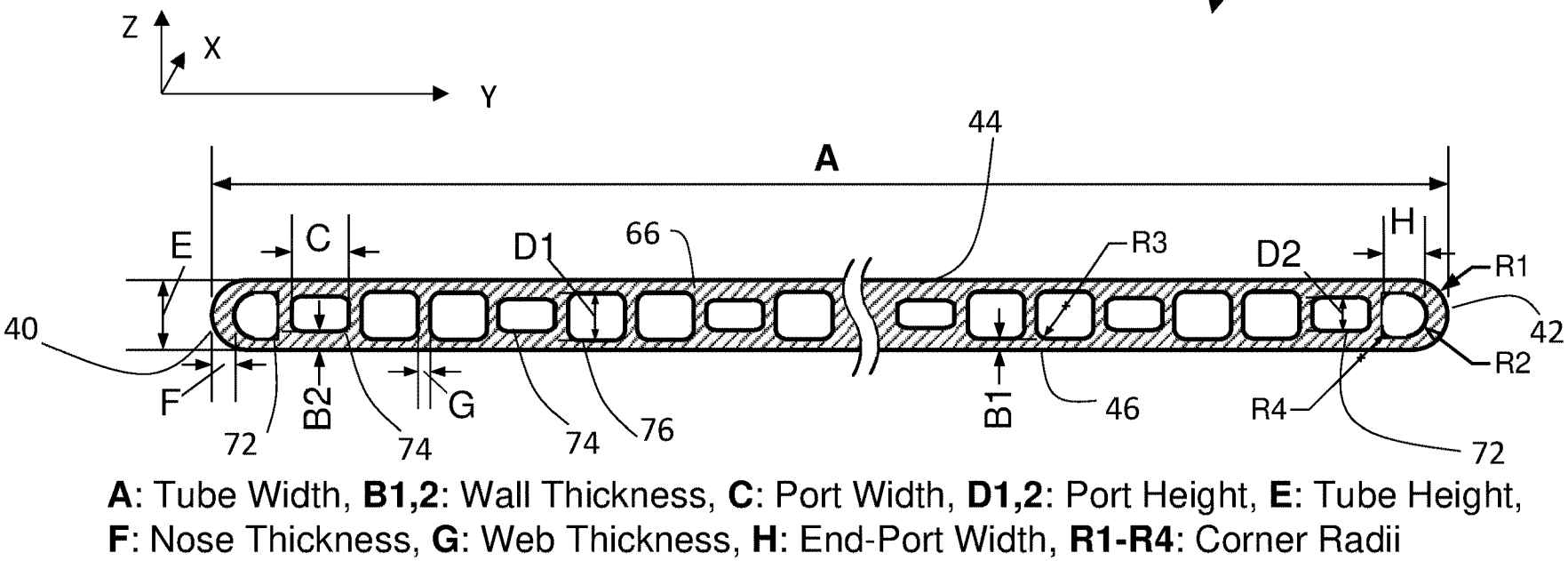
FIG. 6 is a cross-sectional view of a heat exchange tube in an example embodiment.

FIG. 6 is a cross-sectional view of a heat exchange tube 80 in an example embodiment. The cross-sectional view of FIG. 6 depicts the heat exchange tube 80 in the Y-Z plane. Heat exchange tube 80 is similar to heat exchange tube 70 of FIG. 5, with the difference being that more of the interior ports are first interior ports 74. As shown in FIG. 6, the first interior ports 74, having a greater wall thickness along the Z axis, are located not only adjacent to the end ports 72, but also in the interior of the heat exchange tube 80. In FIG. 6, a first interior port 74 is positioned after every two second interior ports 76. It is understood that the placement of the first interior ports 74 relative to the second interior ports 76 may be varied. This pattern of a first interior port 74 followed by two second interior ports 76 further reduces peak stresses on the heat exchange tube 80.

Figure 7:
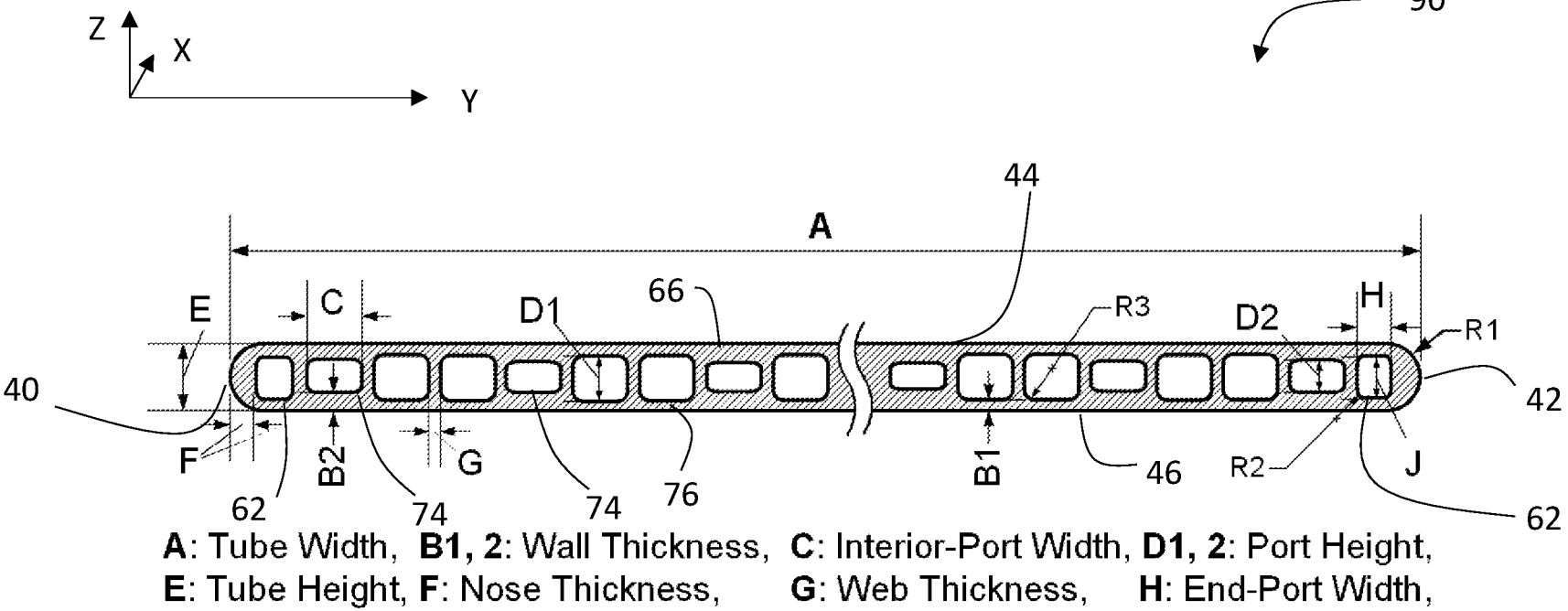
FIG. 7 is a cross-sectional view of a heat exchange tube in an example embodiment.

FIG. 7 is a cross-sectional view of a heat exchange tube 90 in an example embodiment. The cross-sectional view of FIG. 7 depicts the heat exchange tube 90 in the Y-Z plane. FIG. 7 combines elements of FIG. 4 and FIG. 6. The end ports 62 have a generally non-circular, polygonal shape (e.g., rectangular, square) as described with reference to FIG. 4. The heat exchange tube 90 includes first interior ports 74 interspersed with the second interior ports 76 as described with reference to FIG. 6.

The dimensions of the embodiments of FIGS. 4-7 may follow certain relationships with respect to each other, are presented in Table 1 below. The dimensions are normalized with respect to dimension E, the height of the heat exchange tube along the Z axis.

TABLE 1

| | Adjusted Ratio (full range) | | Ratios (example range) | |
|---|---|---|---|---|
| Dimension | Min | Max | Min | Max |
| A | 4 | 40 | 10 | 20 |
| B1 | 0.05 | 0.50 | 0.1 | 0.25 |
| B2 | 0.05 | 0.50 | 0.1 | 0.3 |
| C | 0.10 | 5.00 | 0.5 | 2.0 |
| D1 | 0.05 | 3.00 | 0.05 | 1.5 |
| D2 | 0.05 | 3.00 | 0.05 | 1.5 |
| E | | Normalization parameter | | |
| F | 0.05 | 2.00 | 0.05 | 1.0 |
| G | 0.02 | 0.75 | 0.05 | 0.3 |
| H | 0.05 | 5.00 | 0.1 | 2 |
| J | 0.05 | 4.00 | 0.05 | 1.5 |
| R1 | 0.10 | 2.00 | 0.25 | 0.75 |
| R2 | 0.01 | 0.25 | 0.02 | 0.1 |
| R3 | 0.01 | 0.25 | 0.02 | 0.1 |

Figure 8:
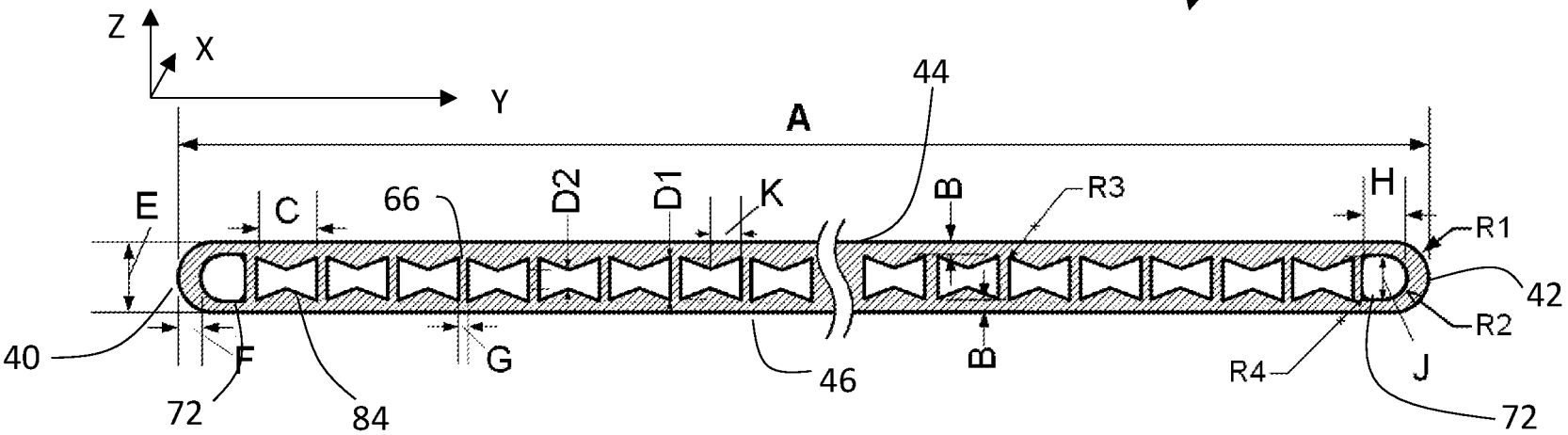
FIG. 8 is a cross-sectional view of a heat exchange tube in an example embodiment.

FIG. 8 is a cross-sectional view of a heat exchange tube 100 in an example embodiment. The cross-sectional view of FIG. 8 depicts the heat exchange tube 100 in the Y-Z plane. In heat exchange tube 100, one or both of the end ports 72 have a rounded interior wall facing the first nose 40 and the second nose 42, respectively, as described above with reference to FIG. 5. The interior ports 84 have a different construction than the ports in FIGS. 4-7. The interior ports 84 are positioned along the Y-axis between the end ports 72. The interior ports 84 include at least one wall having a wall thickness that varies over a width of the interior port 84. The varying wall thickness, B, creates a narrowed passage or throat at a distance, K, from an interior wall of the interior port 84 measured along the Y axis. An interior port height (variable D) ranges from a minimum D2 to a maximum D1. The interior port 84 height varies from the maximum D1, to the minimum D2 and back to the maximum D1, along the widthwise direction of the interior port 84 (i.e., along the Y axis). In the embodiment shown in FIG. 8, the interior surface of the interior port 84 is V-shaped or chevroned, such that the interior port 84 height decreases linearly to a minimum, D2, and then increases linearly to a maximum, D1, as measured along the widthwise direction of the interior port 84 (i.e., along the Y axis). The interior surface of the interior port 84 may follow other contours, such as an arc.

The interior ports 84 may have a symmetric or asymmetric throat. In other words, the minimum height, D2, in the interior of interior port 84 does not need to be in the center of the interior port 84 (e.g., dimension D2 is not at middle of dimension "C" i.e., K≠C/2). The dimensions of FIG. 8 may follow the following relationships.

K=0.1×C to 0.9×C (example range is 0.4×C to 0.6×C)

D2=0.1×D1 to 0.98×D1 where, D1=E−2×B (example range is 0.65×D1 to 0.85×D1)

The dimensions of the embodiments of FIG. 8 may follow certain relationships with respect to each other, are presented in Table 2 below. The majority of the dimensions are normalized with respect to dimension E, the height of the heat exchange tube along the Z axis. Dimension D2 is represented as a fraction of D1, and not normalized by dimension E. Dimension K is represented as a fraction of C, and not normalized by dimension E.

TABLE 2

| | Adjusted Ratio (full range) | | Ratios (example range) | |
|---|---|---|---|---|
| Dimension | Min | Max | Min | Max |
| A | 4 | 40 | 10 | 20 |
| B1 | 0.05 | 0.50 | 0.1 | 0.25 |
| C | 0.10 | 5.00 | 0.5 | 2.0 |
| D1 | 0.05 | 3.00 | 0.05 | 1.5 |
| D2 | 0.1*D1 | 0.98*D1 | 0.65*D1 | 0.85*D1 |
| E | Normalization parameter | | | |
| F | 0.05 | 2.00 | 0.05 | 1.0 |
| G | 0.02 | 0.75 | 0.05 | 0.3 |
| H | 0.05 | 5.00 | 0.1 | 2 |
| J | 0.05 | 4.00 | 0.05 | 1.5 |
| K | 0.1*C | 0.9*C | 0.3*C | 0.6*C |
| R1 | 0.10 | 2.00 | 0.25 | 0.75 |
| R2 | 0.01 | 0.25 | 0.02 | 0.1 |
| R3 | 0.01 | 0.25 | 0.02 | 0.1 |

Figure 9:
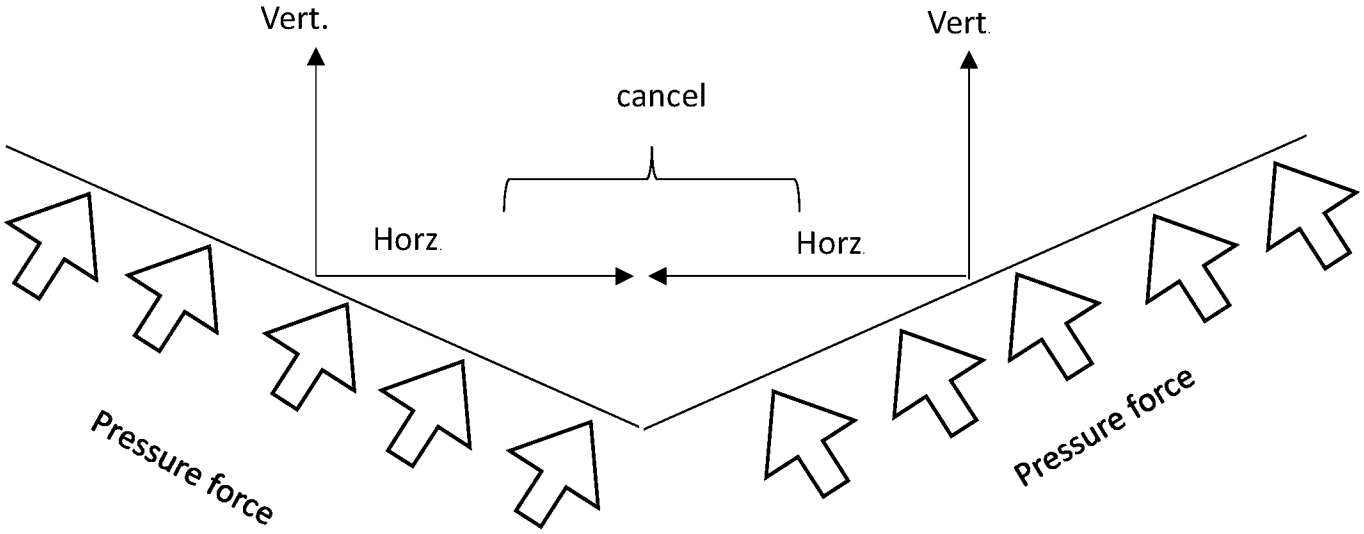
FIG. 9 depicts forces on port walls in an example embodiment.

FIG. 9 depicts pressure forces on walls of the interior port 84 in an example embodiment. Due to the V-shaped interior surface of the interior port 84, horizontal components of the resolved pressure forces (i.e., forces along the Y axis) on either side of the V-shaped walls cancel each other. As a result, only the vertical components of the internal pressure forces are relevant for generating hoop stresses in the port walls. The vertical component being lower than the original pressure forces, it results in lower stresses in the tube.

Figure 10:
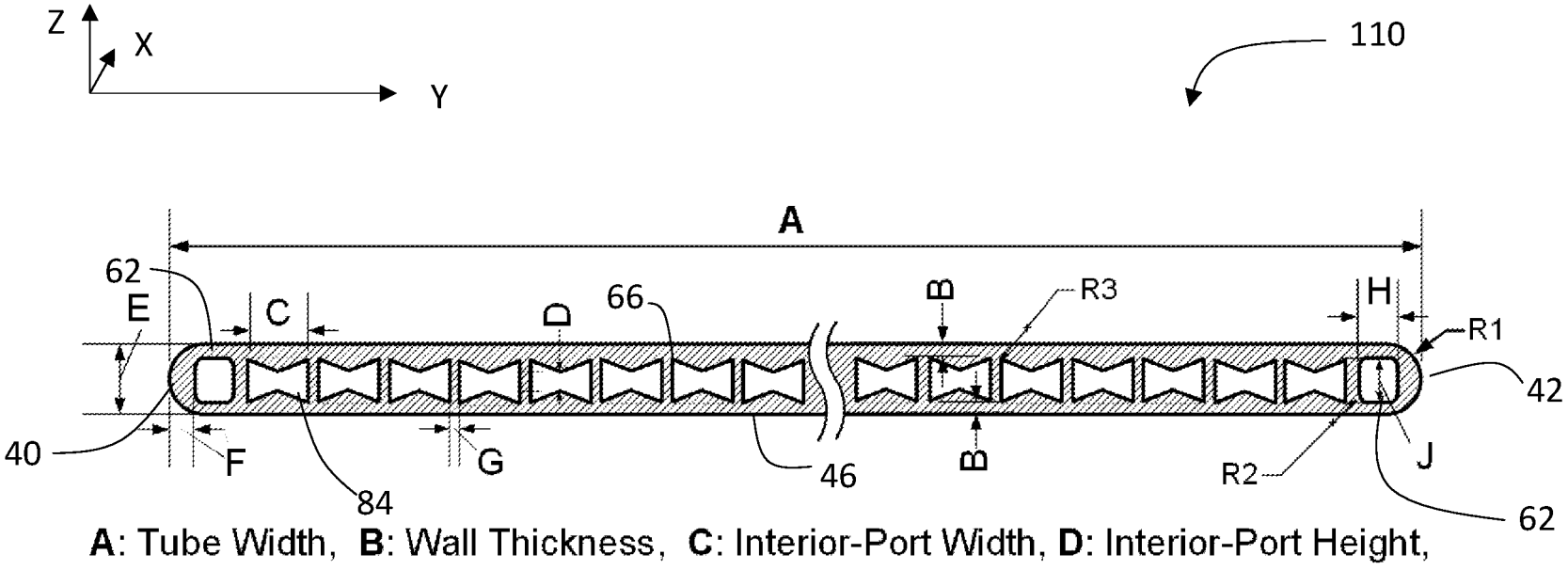
FIG. 10 is a cross-sectional view of a heat exchange tube in an example embodiment.

FIG. 10 is a cross-sectional view of a heat exchange tube 110 in an example embodiment. The cross-sectional view of FIG. 10 depicts the heat exchange tube 110 in the Y-Z plane. In heat exchange tube 110, one or both of the end ports 62 have a generally non-circular, polygonal shape (e.g., rectangular, square) as described above with reference to FIG. 4. The interior ports 84 have the same construction as described with reference to FIG. 8. The dimensions of the embodiments of FIG. 10 may follow certain relationships with respect to each other, are presented in Table 2 above.

Embodiments disclosed herein provide heat exchange tubes using less material than existing designs while will still meeting burst strength requirements.

Dimensions used in this application are intended to include the recited dimension and normal variances due to manufacturing tolerances, measurement tolerances, etc.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A heat exchange tube for use in a heat exchanger, the heat exchange tube comprising:

a first nose and a second nose aligned on a Y axis along a width of the heat exchange tube;

an end port immediately adjacent to the first nose;

a first interior port positioned between the first nose and the second nose;

a second interior port positioned between the first nose and the second nose;

the first interior port having a planar wall extending from one side of the first interior port to a second side of the first interior port, a distance from the planar wall of the first interior port to an outer surface of the heat exchange tube defining a wall having a first thickness, B2, along a Z axis perpendicular to the Y axis;

the second interior port having a planar wall extending from one side of the second interior port to a second side of the second interior port, a distance from the planar wall of the second interior port to the outer surface of the heat exchange tube defining a wall having a second thickness, B1, along the Z axis;

wherein the first thickness, B2, is greater than the second thickness, B1;

a further first interior port having a planar wall extending from one side of the further first interior port to a second side of the further first interior port, a distance from the planar wall of the further first interior port to the outer surface of the heat exchange tube defining a wall having the first thickness, B2, along the Z axis.

2. The heat exchange tube of claim 1:

wherein the end port has a non-circular, polygonal shape.

3. The heat exchange tube of claim 2, wherein the end port is rectangular.

4. The heat exchange tube of claim 2, wherein an interior side of the end port immediately adjacent to the first nose has a curvature of zero.

5. The heat exchange tube of claim 2, wherein the end port has an aspect ratio of width to height ranging from 0.1 to 10.

6. The heat exchange tube of claim 1, wherein the first interior port is immediately adjacent to the end port.

7. The heat exchange tube of claim 1, wherein the first interior port and the further first interior port are positioned on opposite sides of the second interior port along the Y axis.

8. The heat exchange tube of claim 1, further comprising a further second interior port having a planar wall extending from one side of the further second interior port to a second side of the further second interior port, a distance from the planar wall of the further second interior port to the outer surface of the heat exchange tube defining a wall having the first thickness, B1, along the Z axis.

9. The heat exchange tube of claim 8, wherein the first interior port, the second interior port, the further second interior port and the further first interior port are arranged in sequence along the Y axis.

10. A heat exchanger including a heat exchange tube as recited in claim 1.

11. A heat exchange tube for use in a heat exchanger, the heat exchange tube comprising:

a first nose and a second nose aligned on a Y axis along a width of the heat exchange tube;

an end port immediately adjacent to the first nose;

a first interior port positioned between the first nose and the second nose;

a second interior port positioned between the first nose and the second nose;

the first interior port having a wall having a first thickness, B2, along a Z axis perpendicular to the Y axis;

the second interior port having a wall having a second thickness, B1, along the Z axis;

wherein the first thickness is greater than the second thickness;

wherein a ratio of B2/B1 ranges from 1.01 to E/(2B1), where E is a height of the heat exchange tube along the Z axis.

12. The heat exchange tube of claim 11, wherein a ratio of B2/B1 ranges from 1.1 to 1.5.

13. A heat exchange tube for use in a heat exchanger, the heat exchange tube comprising:

a first nose and a second nose aligned on a Y axis along a width of the heat exchange tube;

a port positioned between the first nose and the second nose;

the port having an interior port height along a Z axis perpendicular to the Y axis;

wherein the interior port height varies along the Y axis to define a throat in the port;

wherein the interior port height increases and decreases along the Y axis;

wherein an interior surface of the port is V-shaped;

wherein the interior port height has a minimum offset from a center of the port as measured along the Y axis.

14. The heat exchange tube of claim 13, wherein the port has a width, C, measured along the Y axis and the interior port height has a minimum at a distance K from a from a side wall of the port, where K ranges from 0.1xC to 0.9xC.

15. The heat exchange tube of claim 14, wherein K ranges from 0.4xC to 0.6xC.

16. The heat exchange tube of claim 13, wherein interior port height has a maximum of D1 and a minimum of D2, wherein D2 ranges from 0.1xD1 to 0.98xD1.

17. The heat exchange tube of claim 16, wherein D2 ranges from 0.65xD1 to 0.85xD1.

* * * * *